US008408742B2

(12) United States Patent
Tran

(10) Patent No.: US 8,408,742 B2
(45) Date of Patent: Apr. 2, 2013

(54) LED DAYLIGHT LAMP TUBE

(75) Inventor: Binh Tran, Markham (CA)

(73) Assignee: Shenzhen Eviteo Imp&Exp Co., Ltd. (CN)

( * ) Notice: Subject to any disclaimer, the term of this patent is extended or adjusted under 35 U.S.C. 154(b) by 36 days.

(21) Appl. No.: 13/046,975

(22) Filed: Mar. 14, 2011

(65) Prior Publication Data

US 2012/0236562 A1 Sep. 20, 2012

(51) Int. Cl.
*F21S 4/00* (2006.01)

(52) U.S. Cl. ..... 362/249.02; 362/555; 362/171; 362/217.01; 362/218; 362/311.02

(58) Field of Classification Search ..... 362/551, 362/555, 166, 171, 178, 217.01, 218, 221, 362/227, 230, 231, 236, 237, 240, 249.01, 362/249.02, 260, 311.02
See application file for complete search history.

(56) References Cited

U.S. PATENT DOCUMENTS 4,599,680 A * 7/1986 Gibson et al. ..... 361/679.31
2009/0219713 A1* 9/2009 Siemiet et al. ..... 362/218
2009/0323342 A1* 12/2009 Liu ..... 362/249.02
2010/0220469 A1* 9/2010 Ivey et al. ..... 362/218
2012/0026729 A1* 2/2012 Sanchez et al. ..... 362/218

* cited by examiner

*Primary Examiner* — Evan Dzierzynski
*Assistant Examiner* — Danielle Allen
(74) *Attorney, Agent, or Firm* — Garcia-Zamor IP Law; Ruy M. Garcia-Zamor

(57) ABSTRACT

The invention discloses an LED daylight lamp tube, comprising a tube body and caps fixedly connected to two ends of the tube body, wherein the tube body comprises: an axial bar-shaped radiator, a radiating face of which is fan-shaped and a heat conducting face of which is provided with at least two axial bar-shaped slots forming included angle; an illuminant, which comprises PCB aluminum substrates corresponding in amount to the bar-shaped slots of the radiator, wherein the front face of each of the PCB aluminum substrates is equipped with a plurality of LED illuminants and the PCB aluminum substrates are clamped in the bar-shaped slots of the radiator; a bar-shaped heat conducting gasket, which is adhered to the back face of the PCB aluminum substrate in a fitting manner and clamped between the PCB aluminum substrate and a heat conducting face of the bar-shaped slot; and a circular arc lampshade, which is in clamped connection with two sides of the radiator and forms the cylindrical tube body with the radiator together. According to the LED daylight lamp tube of the invention, the PCB aluminum substrates of the LED illuminants are installed on the fan-shaped radiator at an included angle of 210 degrees, and wide-angle illumination of the LED daylight lamp tube is realized through the two movable caps arranged at two ends of the tube, in addition, the LED daylight lamp tube has better radiating effect and longer service life.

5 Claims, 7 Drawing Sheets

LED DAYLIGHT LAMP TUBE

TECHNICAL FIELD

The invention relates to an light emitting diode (hereinafter refers as "LED") daylight lamp tube, especially to an LED daylight lamp tube suitable for wide-angle illumination and having good radiating effect.

BACKGROUND ART

The majority of the daylight lamp tubes in the prior art is fluorescent tube that is defectively featured by short service life and large energy consumption. With the social development and the raise of people's living level, LED daylight lamp tube gains wide popularity due to long service life and low energy consumption. At present, the typical LED daylight lamp tube comprises a tube body and a cap, the tube body comprises a radiator, a printed circuit board (hereinafter refers as "PCB") which is installed on a radiating device and on which LED illuminants are arranged, and a lampshade, and the traditional LED daylight lamp tube, limited by the single-face illumination of the LED illuminants, has inferior radiation so as to impact on the service life of the LED daylight lamp tube. Therefore, further improvement is required.

CONTENT OF THE INVENTION

In order to overcome the deficiencies in the prior art, the invention provides an LED daylight lamp tube with wide illumination angle, good radiating effect and long service life.

In order to achieve the above purpose, the technical proposal below is adopted:

An LED fluorescent tube comprises a tube body and caps fixedly connected to two ends of the tube body, wherein the tube body comprises:

an axial bar-shaped radiator, a radiating face of which is fan-shaped and a heat conducting face of which is provided with at least two axial bar-shaped slots forming included angle;

an illuminant, which comprises PCB aluminum substrates corresponding in amount to the bar-shaped slots of the radiator, wherein the front face of each of the PCB aluminum substrates is equipped with a plurality of LED illuminants and the PCB aluminum substrates are clamped in the bar-shaped slots of the radiator;

a bar-shaped heat conducting gasket, which is adhered to the back face of the PCB aluminum substrate in a fitting manner and clamped between the PCB aluminum substrate and a heat conducting face of the bar-shaped slot;

and a circular arc lampshade, which is in clamped connection with two sides of the radiator and forms the cylindrical tube body with the radiator together.

The heat conducting face of the radiator is provided with two axial bar-shaped slots, which form an included angle of 210 degrees together and between which a T-shaped partition is arranged.

A slide rail is arranged at the outer side the two bar-shaped slots at the edge of the radiator, respectively; the slot fit for the slide rail is arranged at the edge of two sides of the circular arc lampshade made of optical PC material, respectively, and the circular arc lampshade is in clamped connection with two sides of the radiator through the slots and the slide rails.

The bar-shaped radiator is integrally formed by aluminum alloy and is internally provided with an axial hollow cavity.

The bar-shaped heat conducting gasket is a heat conducting silica gel gasket with high coefficient of heat conductivity.

The cap comprises:

two opposite fixed parts, which are fixedly connected to two ends of the tube body, respectively;

and two opposite movable parts, which are movably connected with the other end of each of the two fixed parts respectively so that the movable parts can be rotated within a set angle in opposition to the fixed parts.

The opposite fixed part is a lamp body holder with one end face fixed at the end of the tube body and the other end face provided with a cylindrical sleeve protruding from the end face, the inner wall of the cylindrical sleeve is provided with an annular buckle, the end face of the lamp body holder at the outer side of the cylindrical sleeve is provided with an annular groove coaxial with the tube, and a plurality of arc grooves are arranged on the inner wall of the annular groove uniformly; and the opposite movable part comprises:

a cap shaft sleeve, wherein one end of the cap shaft sleeve is sleeved with a connecting sleeve the end face of which is fixed with a connecting plate fixation base; the other end of the cap shaft sleeve is provided with a cylindrical sleeve post protruding from the end face and fit for the cylindrical sleeve of the lamp body holder, the outer circumferential face of the cylindrical sleeve post is provided with an annular buckle fit for the buckle on the inner wall of the cylindrical sleeve, the cylindrical sleeve post is provided with a cutting groove for the elastic deformation of the annular buckle; and the end face of the cap shaft sleeve at the outer side of the cylindrical sleeve post is provided with an annular groove;

a rotating sleeve, wherein the rotating sleeve is arranged between the lamp body holder and the cap shaft sleeve and is provided with an annular connecting part fit for the annular groove of the lamp body holder and a sleeve connected with the annular groove on the end face of the cap shaft sleeve, and the side face of the annular connecting part is provided with an arc protrusion fit for the arc groove.

The end face of the lamp body holder is provided with a 180-degree arc groove coaxial with the lamp body holder, and the end face of the cap shaft sleeve, corresponding to the arc groove of the lamp body holder, is provided with a limit protrusion fit for the arc groove.

The opposite movable part further comprises:

two tube installation sleeved holders, which are sleeved with the two ends of the tube respectively and are electrically connected with the tube;

and two cap pressing blocks, which are installed at two ends of the two tube installation sleeved holders, respectively.

According to the daylight lamp tube adopting the above structure, the PCB aluminum substrates of the LED illuminants are installed on the fan-shaped radiator at an included angle of 210 degrees, and wide-angle illumination of the LED daylight lamp tube is realized through the two movable caps arranged at two ends of the tube, in addition, the LED daylight lamp tube has better radiating effect and longer service life.

MODE OF CARRYING OUT THE INVENTION

Detailed description is further made below to the invention with reference to the drawings and the embodiments.

Figure 1:
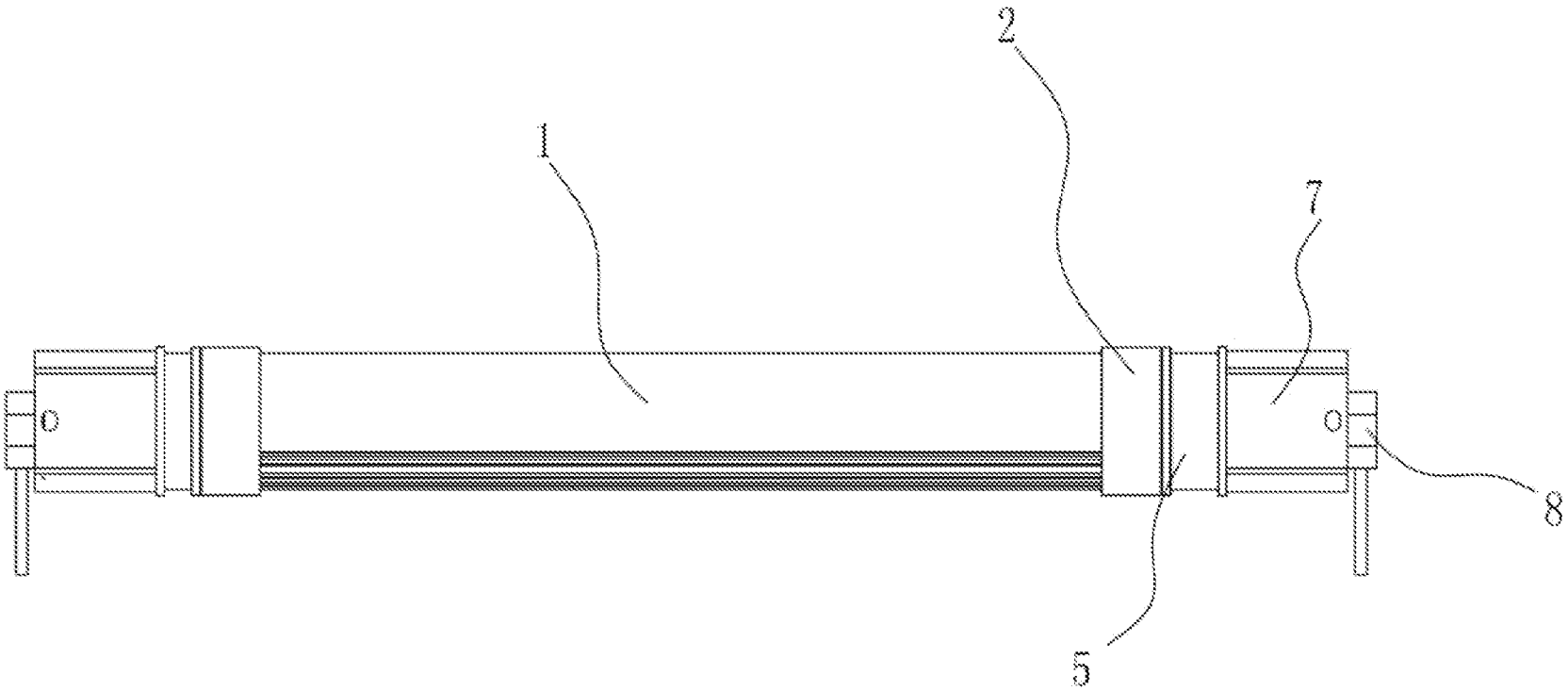
FIG. 1 is a structural schematic diagram of the invention.
Figure 2:
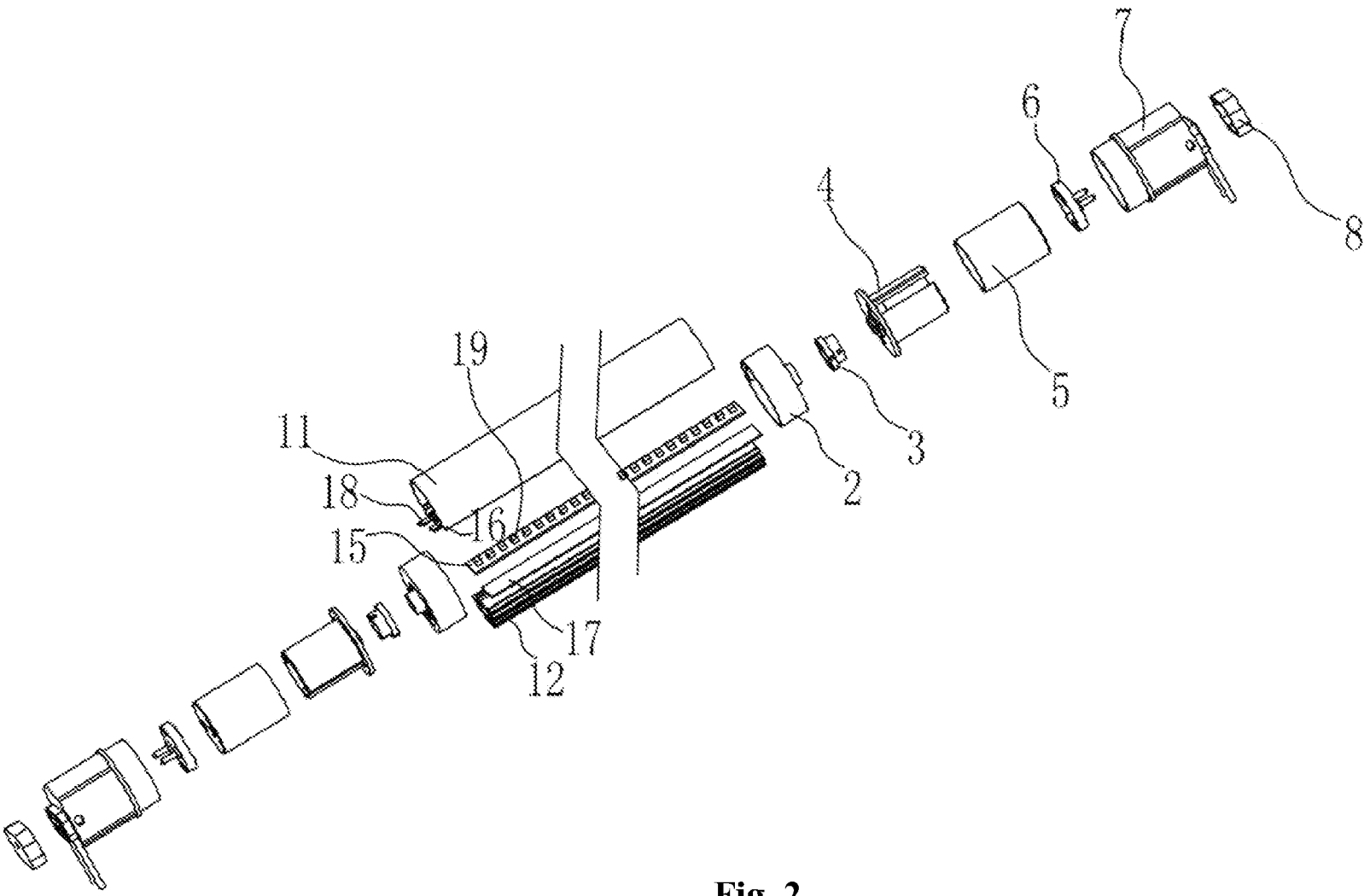
FIG. 2 is an exploded schematic diagram of the invention.
Figure 3:
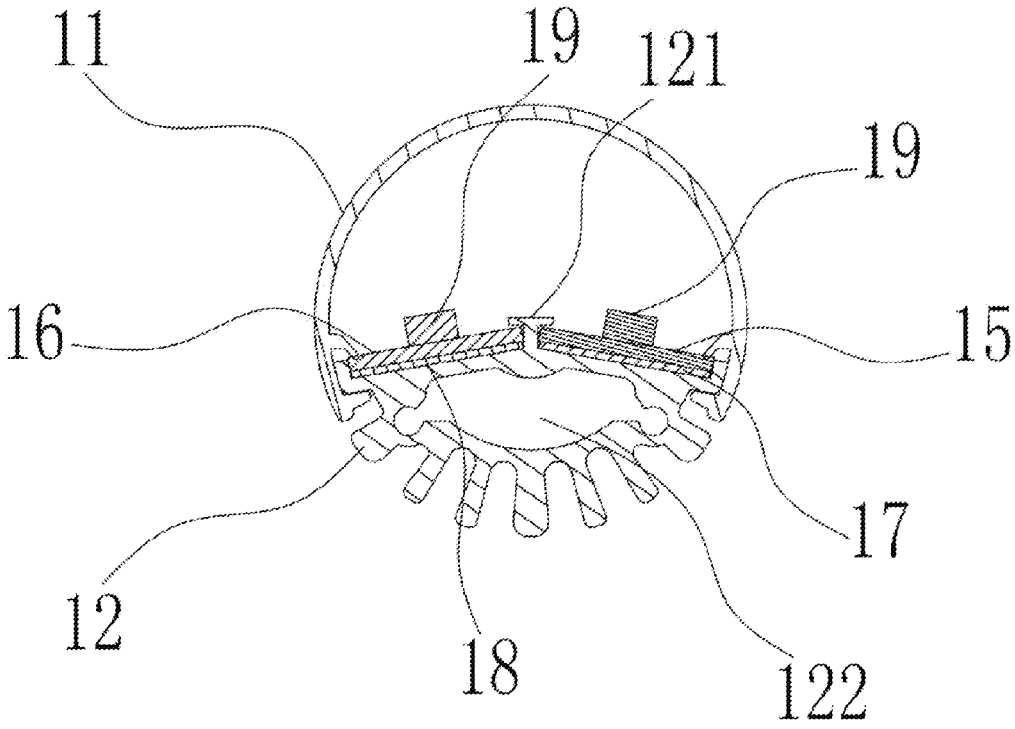
FIG. 3 is a schematic diagram of the section of the tube body of the invention.
Figure 4:
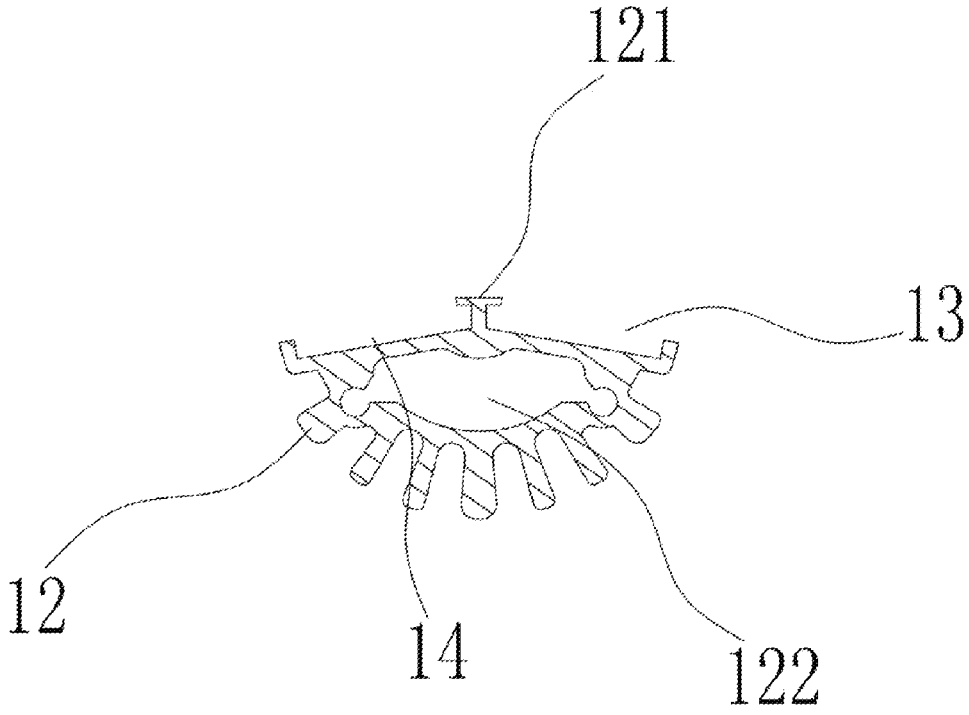
FIG. 4 is a schematic diagram of the section of the radiator of the invention.
Figure 5:
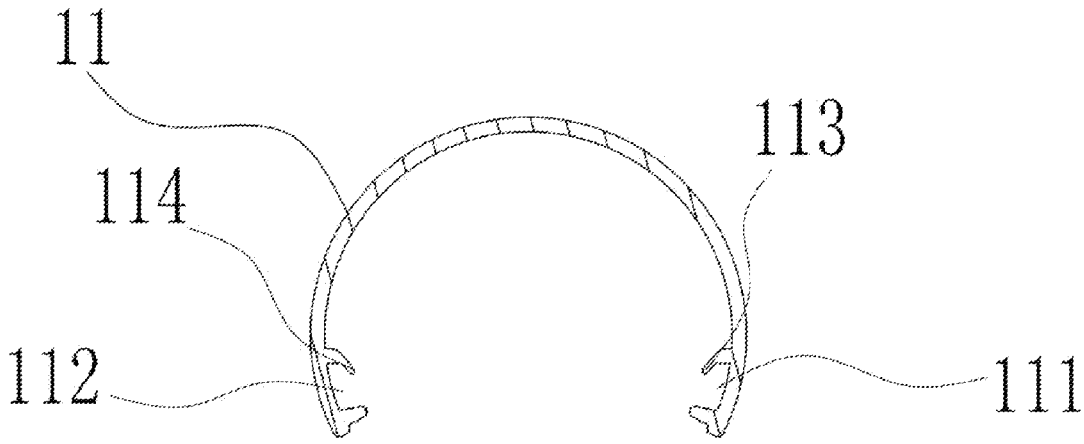
FIG. 5 is a schematic diagram of the section of the lampshade of the invention.
Figure 6:
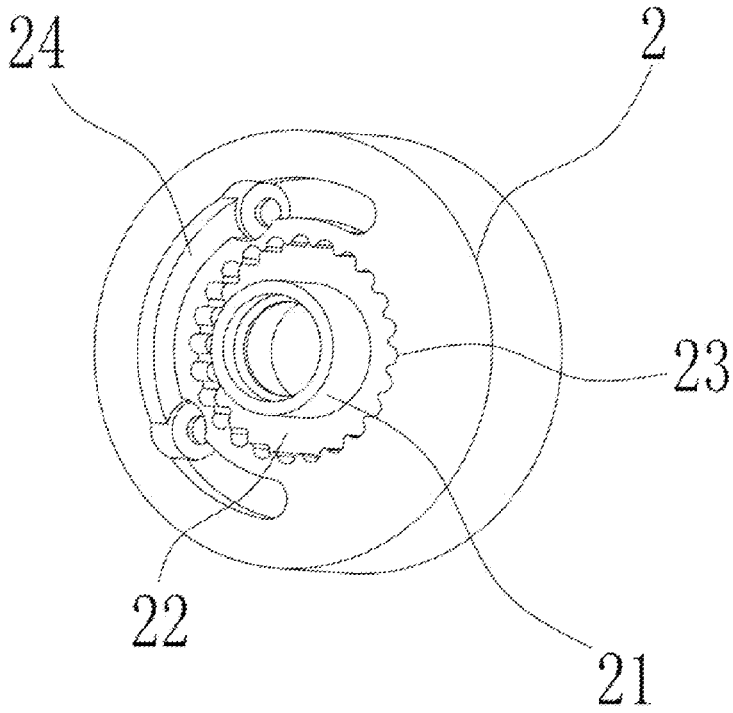
FIG. 6 is a structural schematic diagram of the lamp body holder of the invention.
Figure 7:
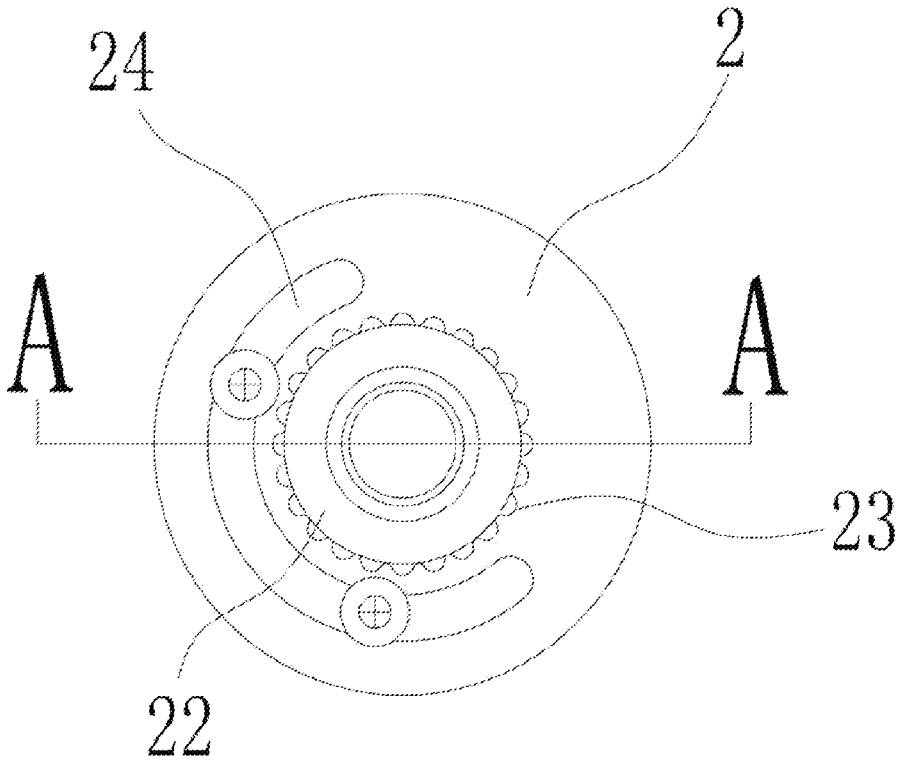
FIG. 7 is a structural schematic diagram of one end face of the lamp body holder of the invention.
Figure 8:
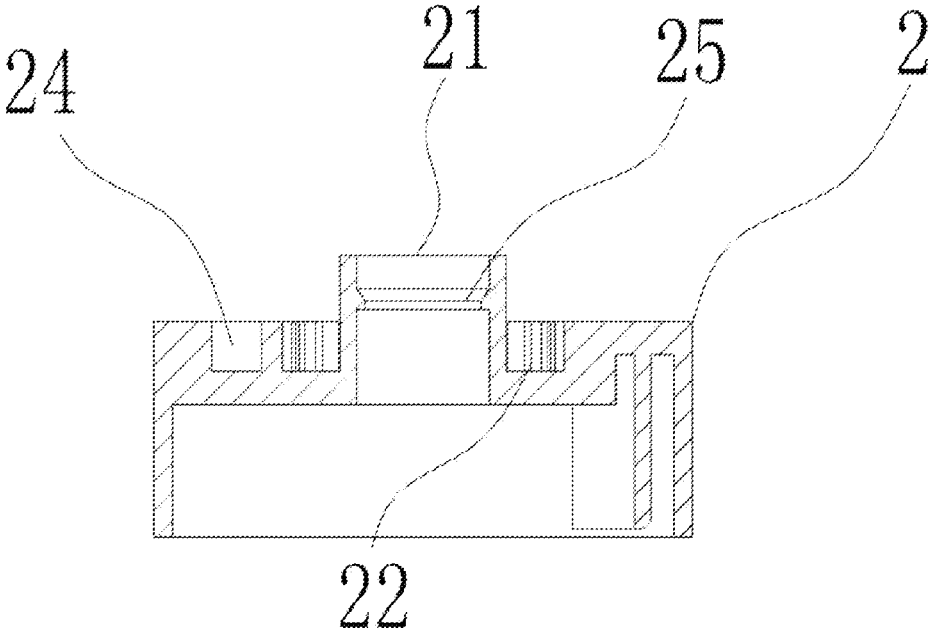
FIG. 8 is a cutaway view of A-A of the FIG. 7.
Figure 9:
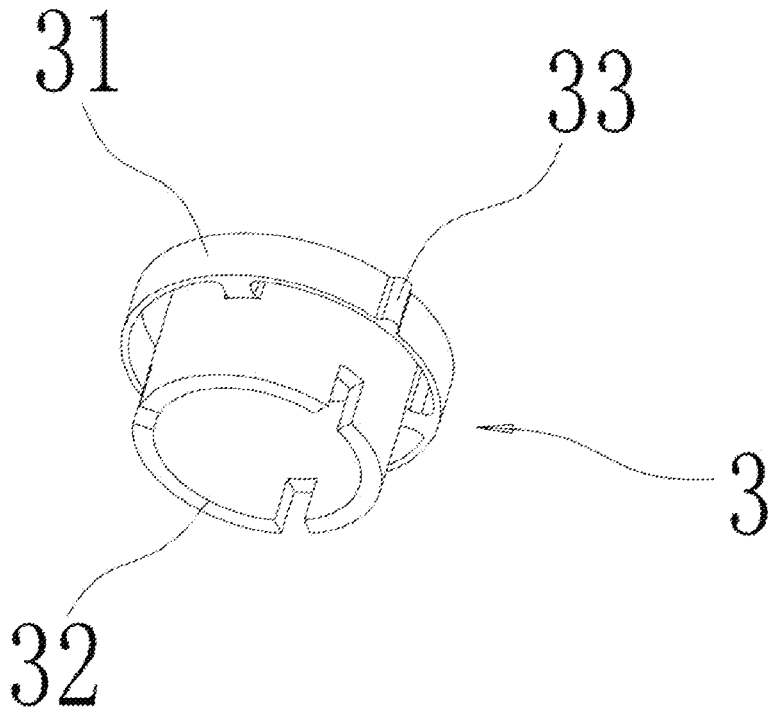
FIG. 9 is a structural schematic diagram of a placement sleeve.
Figure 10:
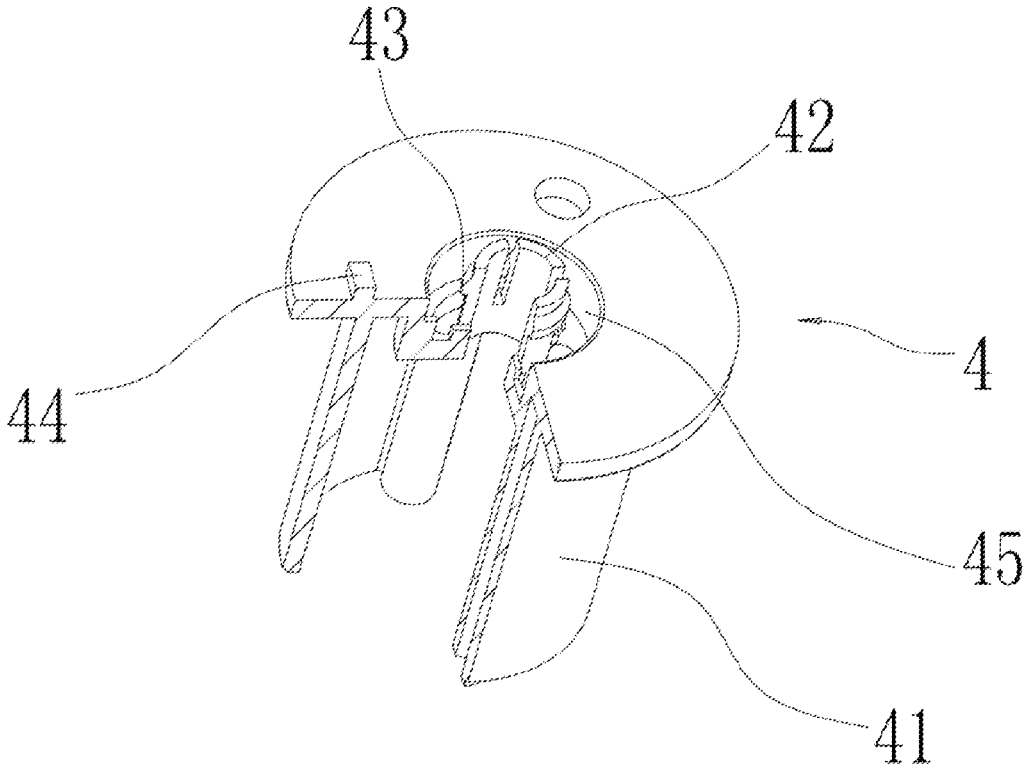
FIG. 10 is a structural schematic diagram of the cap shaft sleeve of the invention.
Figure 11:
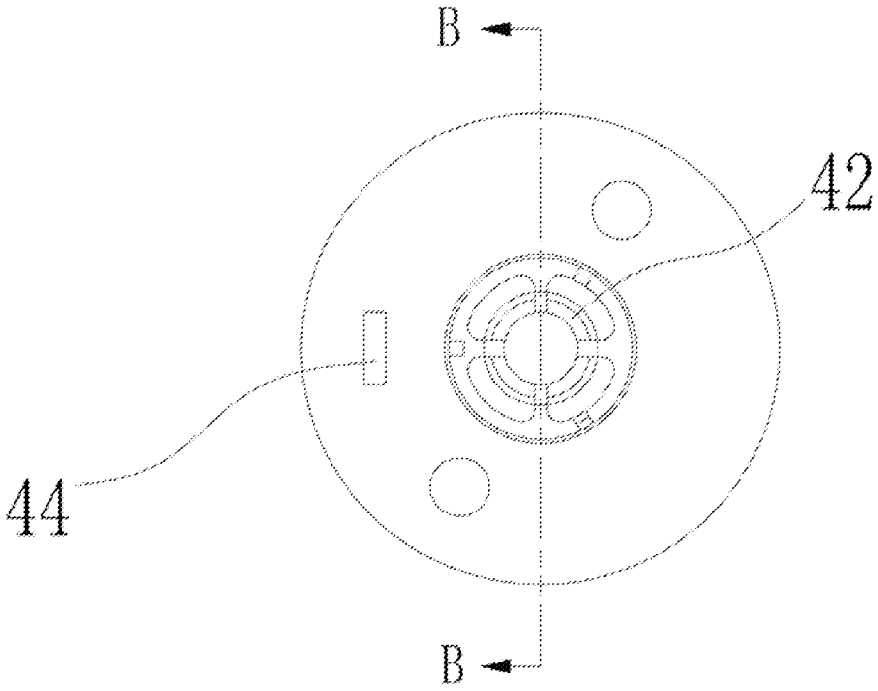
FIG. 11 is a structural schematic diagram of the end face of the cap shaft sleeve of the invention.
Figure 12:
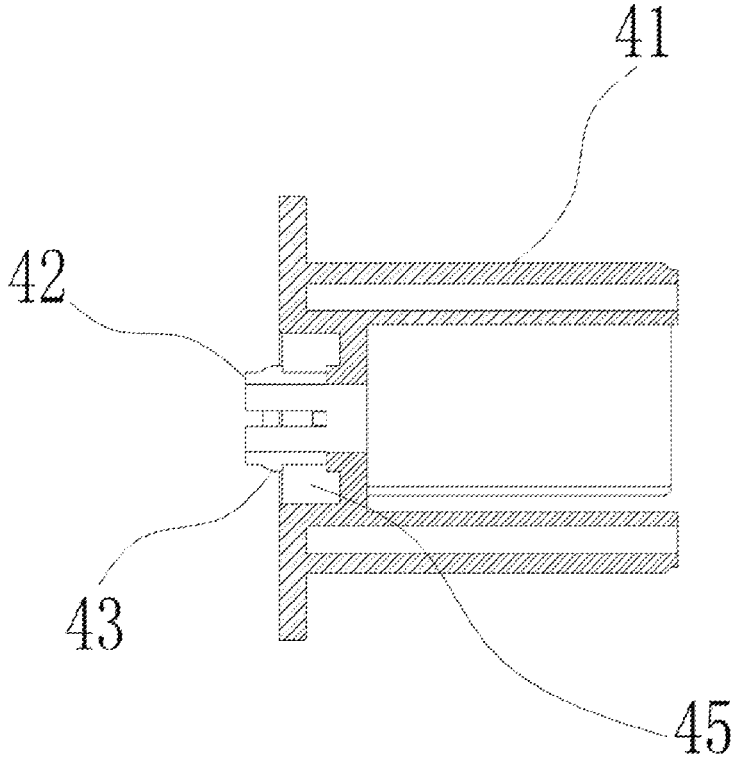
FIG. 12 is a cutaway view of B-B of the FIG. 11.

Shown as FIG. 1 to FIG. 12, an LED daylight lamp tube comprises a tube body 1 and caps fixedly connected to two ends of the tube body, wherein the tube body comprises:

an axial bar-shaped radiator 12. The radiator 12 is integrally formed by aluminum alloy and is provided with an axial hollow cavity 122 on the fan-shaped section thereof in order to reduce the weight of the radiator 12 and provide radiating efficiency. A heat conducting face of the radiator 12 is provided with at least two axial bar-shaped slots 13 and 14, an included angle of 210 degrees is formed by the two axial bar-shaped slots 13 and 14, and a T-shaped partition 121 is arranged between the bar-shaped slots 13 and 14. A slide rail is arranged at the outer side the two bar-shaped slots 13 and 14 of the radiator 12, respectively.

an illuminant. The illuminant comprises PCB aluminum substrates 15 and 16 corresponding to the bar-shaped slots 13 and 14 of the radiator 12, the front faces of the PCB aluminum substrates 15 and 16 is equipped with a plurality of LED illuminants 19 and the PCB aluminum substrates 15 and 16 are clamped in the bar-shaped slots 13 and 14 of the radiator 12.

bar-shaped heat conducting gaskets 17 and 18 with high coefficient of heat conductivity. The bar-shaped heat conducting gaskets 17 and 18 are adhered to the back faces of the PCB aluminum substrates 15 and 16 in a fitting manner and clamped between the PCB aluminum substrate 15 and 16 and heat conducting faces of the bar-shaped slot 13 and 14;

and a circular arc lampshade 11. The slots 111 and 112 fit for the slide rail of the radiator 12 are arranged at the edge of two sides of the circular arc lampshade 11 made of optical PC material, respectively, and the circular arc lampshade 11 is in clamped connection with two sides of the radiator 12 through the slots 111 and 112 and the slide rails, in order to form the cylindrical tube body 1.

The cap comprises two opposite fixed parts, which are fixedly connected to two ends of the tube body, respectively, and two opposite movable parts, which are movably connected with the other end of each of the two fixed parts respectively so that the movable parts can be rotated within a set angle in opposition to the fixed parts.

The opposite fixed part is a lamp body holder 2 with one end face fixed at the end of the tube body 1 and the other end face provided with a cylindrical sleeve 21 protruding from the end face, the inner wall of the cylindrical sleeve 21 is provided with an annular buckle 25, the end face of the lamp body holder 2 at the outer side of the cylindrical sleeve 21 is provided with an annular groove 22 coaxial with the tube, and a plurality of arc grooves 23 are arranged on the inner wall of the annular groove 22 uniformly; and the end face of the lamp body holder 2 at the outer side of the annular groove 22 is provided with a 180-degree arc groove 24 coaxial with the lamp body holder.

The opposite movable part comprises:

a cap shaft sleeve 4, wherein one end 41 of the cap shaft sleeve 4 is sleeved with a connecting sleeve 5 the end face of which is fixed with a connecting plate fixation base 6; the other end of the cap shaft sleeve 4 is provided with a cylindrical sleeve post 42 protruding from the end face and fit for the cylindrical sleeve 21 of the lamp body holder 2, the outer circumferential face of the cylindrical sleeve post 42 is provided with an annular buckle 43 fit for the buckle 25 on the inner wall of the cylindrical sleeve 21, the cylindrical sleeve post 42 is provided with a cutting groove for the elastic deformation of the annular buckle 43; and the end face of the cap shaft sleeve 4 at the outer side of the cylindrical sleeve post 42 is provided with an annular groove 45, and the end face of the cap shaft sleeve 4, corresponding to the arc groove 24 of the lamp body holder 2, is provided with a limit protrusion 44 fit for the arc groove 24, so that the lamp body holder 2 and the cap shaft sleeve 4 can be rotated oppositely at an angle of 180 degrees.

a rotating sleeve 3, wherein the rotating sleeve 3 is arranged between the lamp body holder 2 and the cap shaft sleeve 4 and is provided with an annular connecting part 31 fit for the annular groove 22 of the lamp body holder 2 and a sleeve 32 connected with the annular groove 45 on the end face of the cap shaft sleeve 4, and the side face of the annular connecting part 31 is provided with an arc protrusion 33 fit for the arc groove 23, and the rotating angle of the lamp body holder 2 and the cap shaft sleeve 4 can be positioned.

Further, the opposite movable part further comprises two tube installation sleeved holders 7, which are sleeved with the two ends of the tube body 1 respectively and are electrically connected with the tube body 1, and two cap pressing blocks 8, which are installed at two ends of the two tube installation sleeved holders 7, respectively.

According to the daylight lamp tube of the invention, the PCB aluminum substrates of the LED illuminants are installed on the fan-shaped radiator at an included angle of 210 degrees, and wide-angle illumination of the LED daylight lamp tube is realized through the two movable caps arranged at two ends of the tube, in addition, the LED daylight lamp tube has better radiating effect and longer service life.

It is understandable that, the description above pertaining to the embodiments, although in detail, shall not be considered as the limitation to the scope of protection of the invention, which shall be based on the claims attached.

What is claimed is:

1. A light emitting diode fluorescent tube comprising a tube body and caps fixedly connected to two ends of the tube body, characterized in that: the tube body comprises:

an axial bar-shaped radiator, a radiating face of which is fan-shaped and a heat conducting face of which is provided with at least two axial bar-shaped slots forming an included angle;

an illuminant, which comprises printed circuit board aluminum substrates corresponding in amount to the bar-shaped slots of the radiator, wherein the front face of each of the printed circuit board aluminum substrates is equipped with a plurality of light emitting diode illuminants and the printed circuit board aluminum substrates are clamped in the bar-shaped slots of the radiator;

a bar-shaped heat conducting gasket, which is adhered to the back face of the printed circuit board aluminum substrate in a fitting manner and clamped between the printed circuit board aluminum substrate and a heat conducting face of the bar-shaped slot;

a circular arc lampshade, which is in clamped connection with two sides of the radiator and forms the cylindrical tube body with the radiator together;

wherein the cap comprises:

two opposite fixed parts, which are fixedly connected to two ends of the tube body, respectively; and two opposite movable parts, which are movably connected with the other end of each of the two fixed parts respectively so that the movable parts can be rotated within a set angle in opposition to the fixed parts;

wherein the opposite fixed part is a lamp body holder with one end face fixed at the end of the tube body and the other end face provided with a cylindrical sleeve protruding from the end face, the inner wall of the cylindrical sleeve is provided with an annular buckle, the end face of the lamp body holder at the outer side of the cylindrical sleeve is provided with an annular groove coaxial with the tube, and a plurality of arc grooves are arranged on the inner wall of the annular groove uniformly; and the opposite movable part comprises: a cap shaft sleeve, wherein one end of the cap shaft sleeve is sleeved with a connecting sleeve the end face of which is fixed with a connecting plate fixation base; the other end of the cap shaft sleeve is provided with a cylindrical sleeve post protruding from the end face and fit for the cylindrical sleeve of the lamp body holder, the outer circumferential face of the cylindrical sleeve post is provided with an annular buckle fit for the buckle on the inner wall of the cylindrical sleeve, the cylindrical sleeve post is provided with a cutting groove for the elastic deformation of the annular buckle; and the end face of the cap shaft sleeve at the outer side of the cylindrical sleeve post is provided with an annular groove;

a rotating sleeve, wherein the rotating sleeve is arranged between the lamp body holder and the cap shaft sleeve and is provided with an annular connecting part fit for the annular groove of the lamp body holder and a sleeve connected with the annular groove on the end face of the cap shaft sleeve, and the side face of the annular connecting part is provided with an arc protrusion fit for the arc groove.

2. The light emitting diode fluorescent tube according to claim 1, characterized in that the bar-shaped radiator is integrally formed by aluminum alloy and is internally provided with an axial hollow cavity.

3. The light emitting diode fluorescent tube according to claim 1, characterized in that the heat conducting gasket is a heat conducting silica gel gasket with high coefficient of heat conductivity.

4. The light emitting diode fluorescent tube according to claim 1, characterized in that the end face of the lamp body holder is provided with a 180-degree arc groove coaxial with the lamp body holder, and the end face of the cap shaft sleeve, corresponding to the arc groove of the lamp body holder, is provided with a limit protrusion fit for the arc groove.

5. The light emitting diode fluorescent tube according to claim 1, characterized in that the opposite movable part further comprises:

two tube installation sleeved holders, which are sleeved with the two ends of the tube respectively and are electrically connected with the tube;

and two cap pressing blocks, which are installed at two ends of the two tube installation sleeved holders, respectively.

* * * * *